US006321857B1

(12) United States Patent
Eddison

(10) Patent No.: US 6,321,857 B1
(45) Date of Patent: Nov. 27, 2001

(54) DIRECTIONAL DRILLING APPARATUS AND METHOD UTILIZING ECCENTRIC STABILIZER

(75) Inventor: Alan Martyn Eddison, Stonehaven (GB)

(73) Assignee: Andergauge Limited, Scotland (GB)

( * ) Notice: Subject to any disclaimer, the term of this patent is extended or adjusted under 35 U.S.C. 154(b) by 0 days.

(21) Appl. No.: 09/202,342

(22) PCT Filed: Jun. 13, 1997

(86) PCT No.: PCT/GB97/01596

§ 371 Date: Dec. 14, 1998

§ 102(e) Date: Dec. 14, 1998

(87) PCT Pub. No.: WO97/47848

PCT Pub. Date: Dec. 18, 1997

(30) Foreign Application Priority Data

Jun. 14, 1996 (GB) ..... 9612524

(51) Int. Cl.[7] ..... E21B 7/08

(52) U.S. Cl. ..... 175/61; 175/325.3; 175/76

(58) Field of Search ..... 175/61, 325.3, 175/325.5, 74, 73, 106, 101, 76

(56) References Cited

U.S. PATENT DOCUMENTS

| | | | | |
|---|---|---|---|---|
| 4,076,084 | | 2/1978 | Tighe . | |
| 4,185,704 | * | 1/1980 | Nixon, Jr. | 175/76 |
| 4,220,213 | | 9/1980 | Hamilton . | |
| 4,638,873 | | 1/1987 | Welborn . | |
| 4,739,843 | * | 4/1988 | Burton | 175/73 |
| 5,038,872 | * | 8/1991 | Shirley | 175/76 |
| 5,040,619 | | 8/1991 | Jordan . | |
| 5,186,264 | * | 2/1993 | Du Chaffaut | 175/27 |
| 5,213,168 | * | 5/1993 | Warren et al. | 175/61 |
| 5,220,963 | | 6/1993 | Patton . | |
| 5,318,138 | * | 6/1994 | Dewey et al. | 175/74 |
| 5,423,389 | * | 6/1995 | Warren et al. | 175/75 |
| 5,484,029 | * | 1/1996 | Eddison | 175/73 |
| 5,490,569 | * | 2/1996 | Brotherton et al. | 175/61 |
| 5,529,133 | * | 6/1996 | Eddison | 175/61 |
| 5,941,321 | * | 8/1999 | Hughes | 175/61 |
| 5,979,570 | * | 11/1999 | McLoughlin et al. | 175/24 |

FOREIGN PATENT DOCUMENTS 0409446 1/1991 (EP) .

* cited by examiner

*Primary Examiner*—William Neuder
*Assistant Examiner*—Kristine Markovich
(74) *Attorney, Agent, or Firm*—Alston & Bird LLP

(57) ABSTRACT

Directional drilling apparatus (26) for location on a drill string (20) comprises a stabilizer (32) having a mandrel (38) for connection to the drill string (20) and an eccentric non-rotating element (46) mounted on the mandrel (38) for offsetting the string (20) in the bore (22) and a non-rotating offset mass (34) for maintaining the element (46) at a selected orientation relative to the bore (22) as the drill string (20) rotates.

23 Claims, 7 Drawing Sheets

DIRECTIONAL DRILLING APPARATUS AND METHOD UTILIZING ECCENTRIC STABILIZER

FIELD OF THE INVENTION

Figure 1:
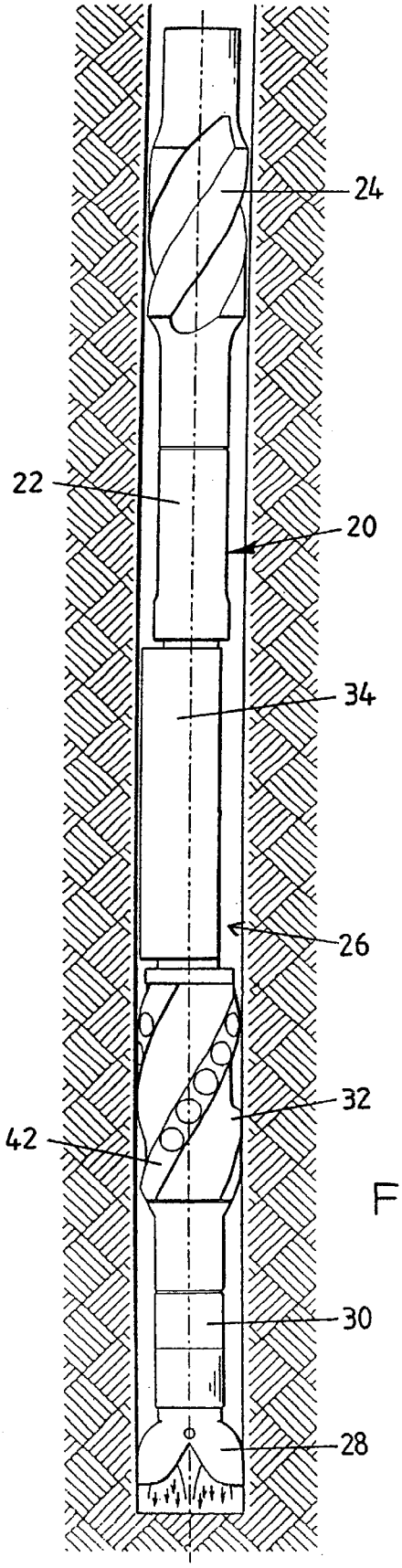

This invention relates to drilling apparatus, and in particular to apparatus for use in directional drilling and a directional drilling method.

BACKGROUND OF THE INVENTION

In directional or controlled trajectory drilling, the S vertical inclination and azimuth of a drilled bore may be controlled such that the bore may extend from the surface to a target area which is not vertically aligned with the point on the surface where drilling commences. This permits a wide area to be accessed from a single drilling location and is therefore particularly useful in offshore drilling operations.

Rotation of the drill bit mounted on the lower end of the drill string is achieved by rotation of the entire drill string, by a turntable on the surface, and often also by a downhole motor located on the drill string adjacent the bit. The downhole motor is usually driven by the drilling fluid which is pumped through the string. Steerable downhole motors include a "bent" housing or elbow which introduces a small deviation (around 1°) in the end portion of the drill string. When the entire string is rotating such an elbow has little or no effect on the bore trajectory. However, if the string is stopped and then adjusted such that the motor bend is in a desired direction, rotating the drill bit using only the downhole motor will result in the trajectory of the well deviating. Drilling in this manner without rotation of the drill string may be very time consuming as static friction between the non-rotating parts of the string and the bore wall tends to produce a stick-slip progression of the string through the bore. This results in sudden increases in the weight (downward force) being applied to the bit and motor, causing the motor co stall. The drill string must then be picked off bottom before drilling may restart. This problem may even result in it becoming impossible to drill any further without rotating the drill string and is particularly acute in horizontal and extended reach wells.

Attempts have been made to provide drilling apparatus which will permit bore trajectory to be varied or controlled while still rotating the drill string, primarily by providing a non-rotating eccentric mass on the drill string adjacent the drill bit, and which mass engages the "low" portion of the bore wall and supports the drill string. A radially extending blade is mounted on the mass and engages the bore to produce a lateral force on the drill string causing the drill bit to deviate from its existing path, or at least prevents further deviation in the direction of the blade. However, the success of such apparatus has been limited as the mass provides an unstable support for the heavy drill string, such that the mass is likely to topple and be moved to one side by the string, which will tend to move downwards to occupy the lower part of the bore. Examples of such arrangements are illustrated in U.S. Pat. Nos. 4,638,873 and 4,220,213.

Other forms of directional drilling apparatus for controlling hole direction or inclination by providing eccentric or offset blades or members are described in U.S. Pat. Nos. 3,062,303, 3,092,188, 3,650,338, 3,825,081 and 4,305,474.

OBJECTS AND SUMMARY OF THE INVENTION

It is among the objectives of the embodiments of the present invention to provide directional drilling apparatus utilising an offset or eccentric mass which obviates or mitigates the disadvantages of the prior art arrangements.

According to the present invention there is provided directional drilling apparatus for location on a drill string, the apparatus comprising:

a stabiliser having a mandrel for connection to the drill string and an eccentric non-rotating element mounted on the mandrel for offsetting the string in the bore; and orientation control means operatively associated with the non-rotating element and including a non-rotating offset mass for maintaining said element at a selected orientation relative to the bore as the drill string rotates therein.

In use, the invention permits the drill string to be rotated while the bore trajectory is controlled or adjusted.

Preferably, the stabiliser is of a larger gauge than the non-rotating offset mass. Accordingly, the non-rotating offset mass is held clear of the bore wall and depends from the string. The stabiliser is preferably of the same gauge as the bore or is of slightly smaller gauge than the bore.

Preferably, the orientation control means includes a mandrel for connection to the drill string with the offset mass being rotatable on the mandrel, the mass being connectable to the eccentric stabiliser element. In one embodiment, the mass may be fixed relative to the eccentric stabiliser element such that the element may only assume a single orientation within a bore, in another embodiment, the eccentric stabiliser element may be positioned in one of two orientations relative to the offset mass, to turn the bore to the "left" or "right"; if such an apparatus is provided in conjunction with a conventional adjustable stabiliser the driller may utilise the apparatus to control the bore azimuth and the stabiliser to control the bore inclination, in the preferred embodiment, the mass may be disengaged from the stabiliser element to permit the relative positions thereof to be varied as desired, and thus vary the orientation of the stabiliser relative to the bore and permit drilling of a bore or varying inclination and azimuth solely by means of the apparatus.

It is preferred that disengagement and re-engagement of the mass and stabiliser element may be executed remotely, from the surface, to avoid the requirement to retract the drill string from the bore. In one embodiment a clutch is provided between the mass and stabiliser element and may be disengaged by, for example, picking up the drill string. The clutch preferably has a locked configuration to prevent accidental disengagement. Locking and unlocking may be accomplished by any suitable means, including a drilling fluid actuated latch. Preferably, the clutch includes means for connecting the mandrel relative to the non-rotating stabiliser element and which operates on the clutch disengaging. This permits the eccentric element to be rotated to a desired orientation by rotation of the string. On the clutch re-engaging the connecting means disengages the element from the mandrel.

The non-rotating eccentric element may be a cam for location between the mandrel and an outer stabiliser body including extendible bearing elements including cam follower portions; as the mandrel and outer body rotate in the bore relative to the non-rotating cam, the bearing elements are extended and retracted by the cam. Alternatively, the non-rotating element may be an eccentric stabiliser body.

Preferably also, a further stabiliser is provided on the string above the eccentric stabiliser.

BRIEF DESCRIPTION OF THE INVENTION

Figure 2:
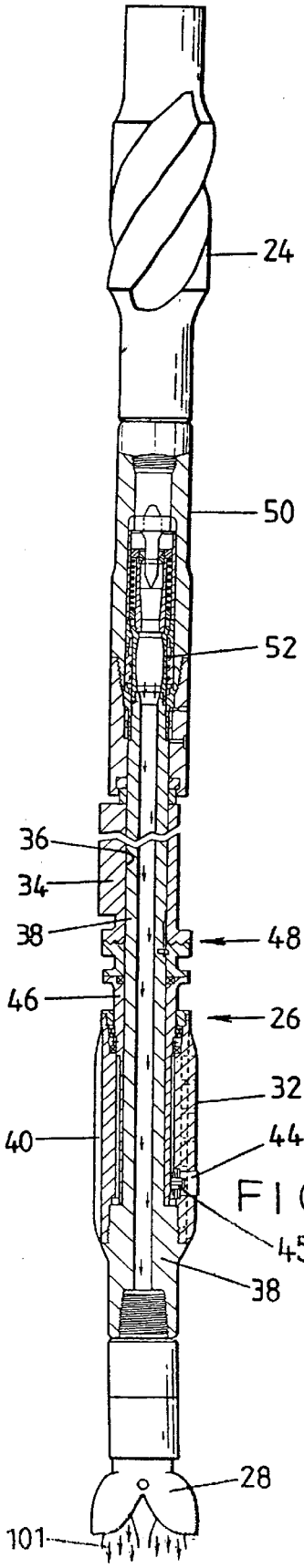
Figure 3:
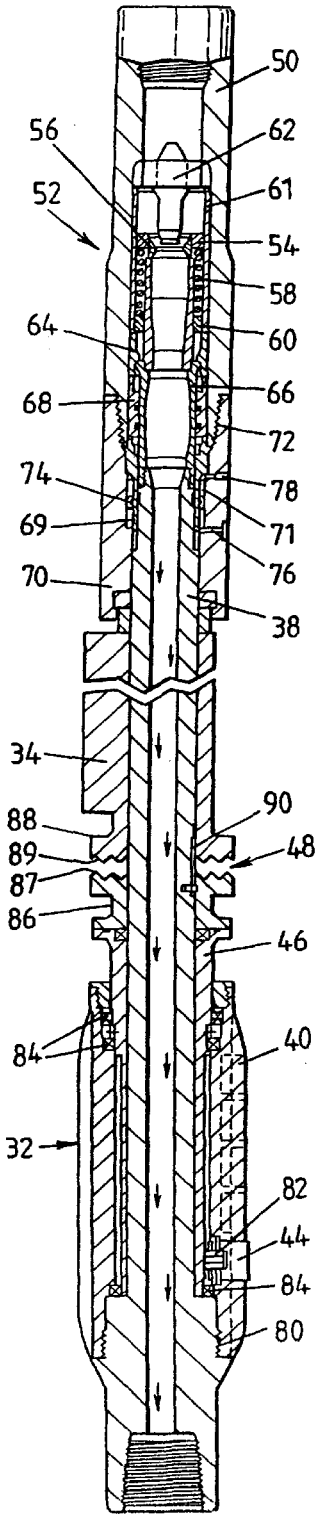
Figure 4:
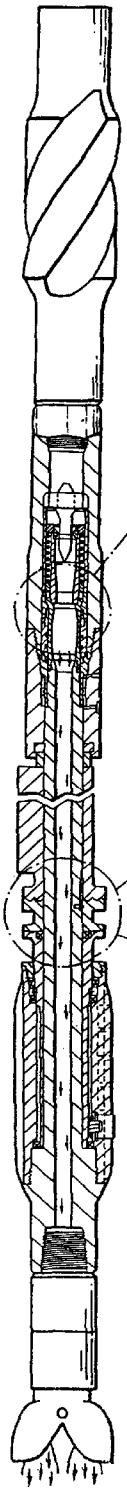
Figure 5:
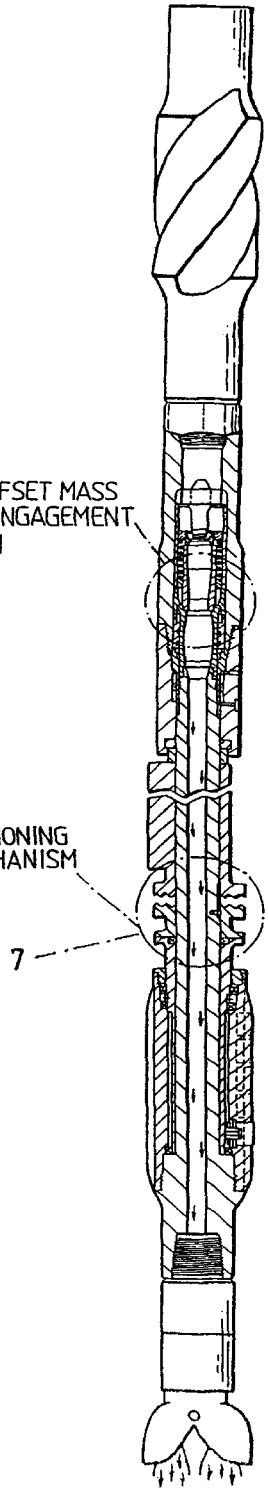
Figure 6:
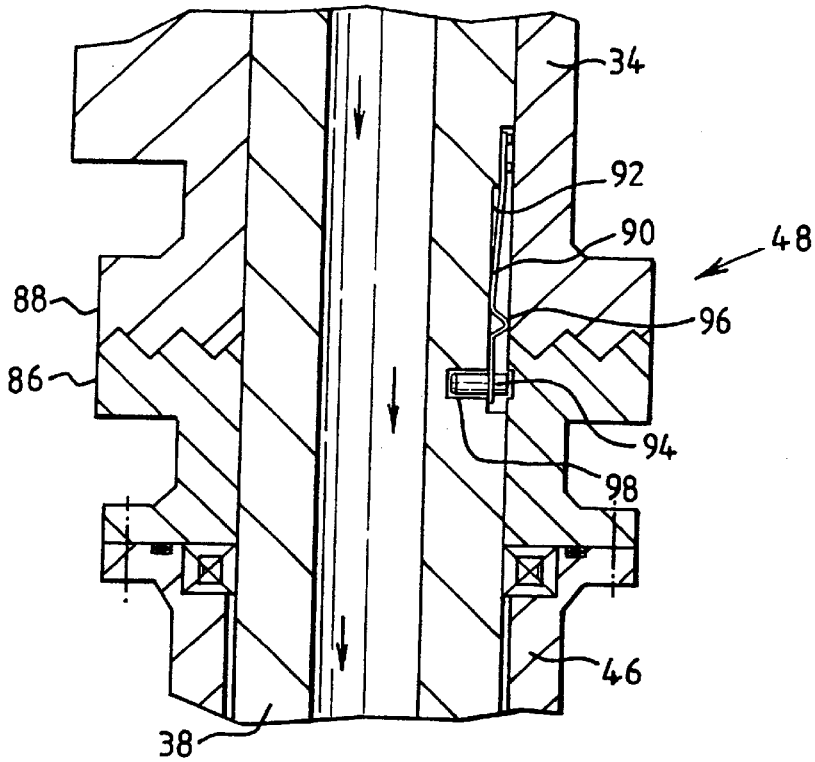
Figure 7:
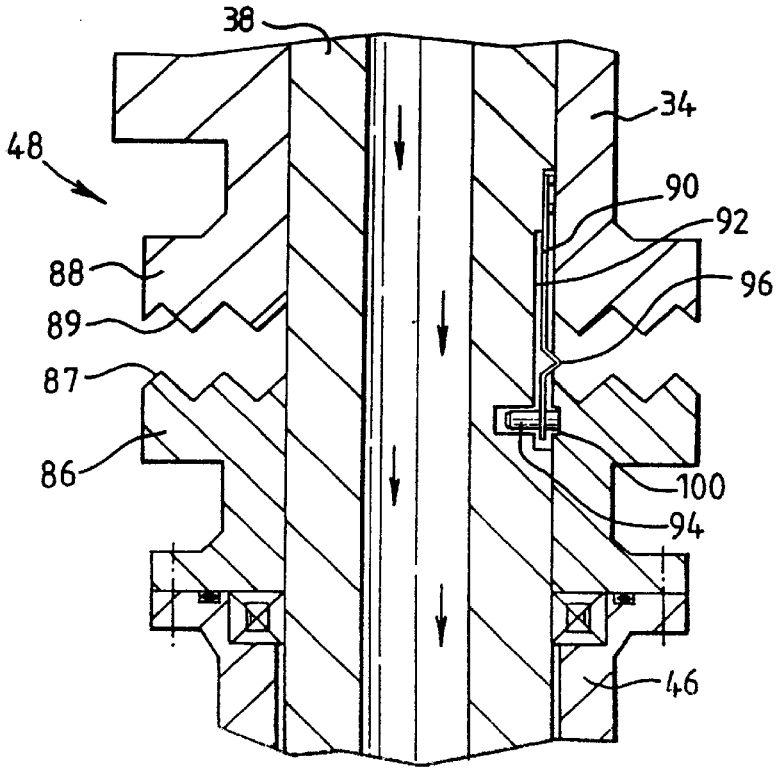
Figure 8:
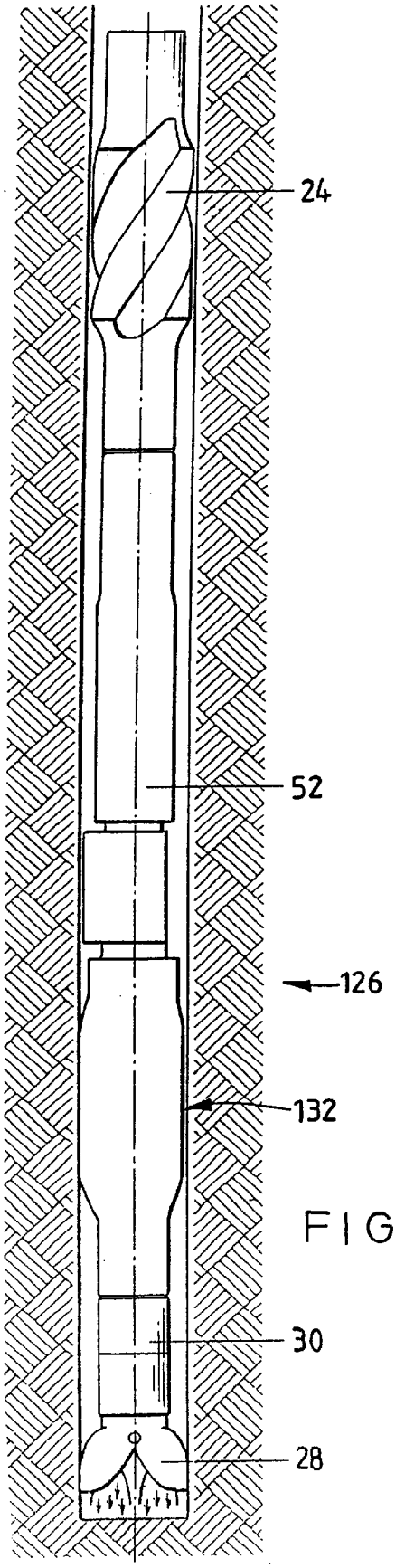
Figure 9:
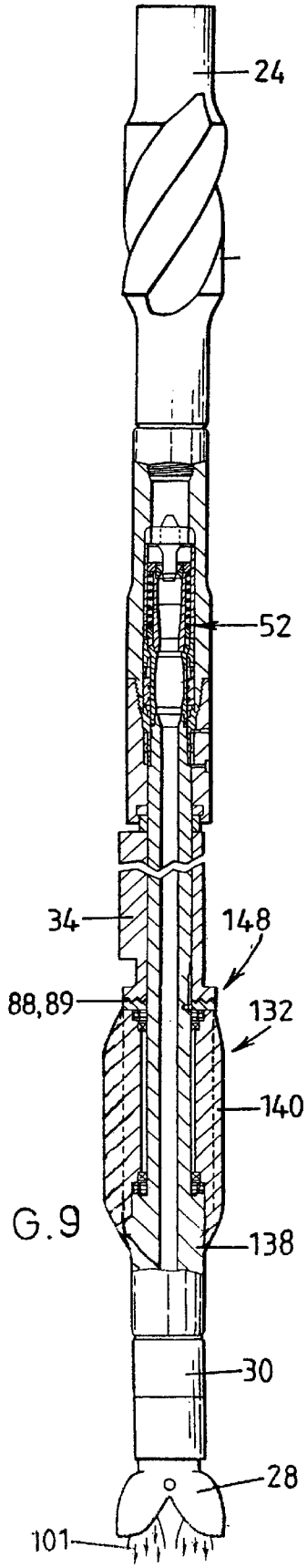
Figure 10:
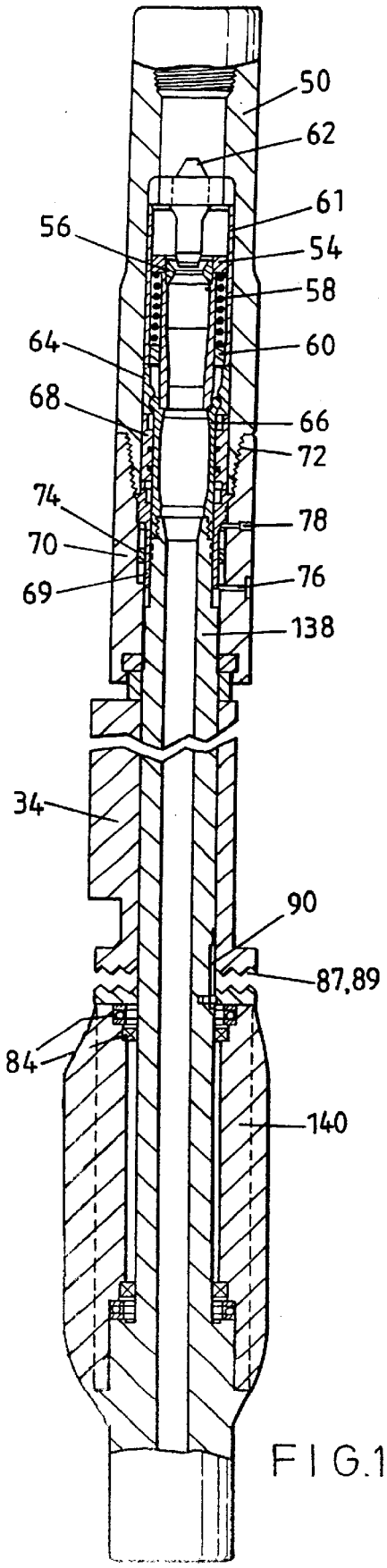
Figure 11:
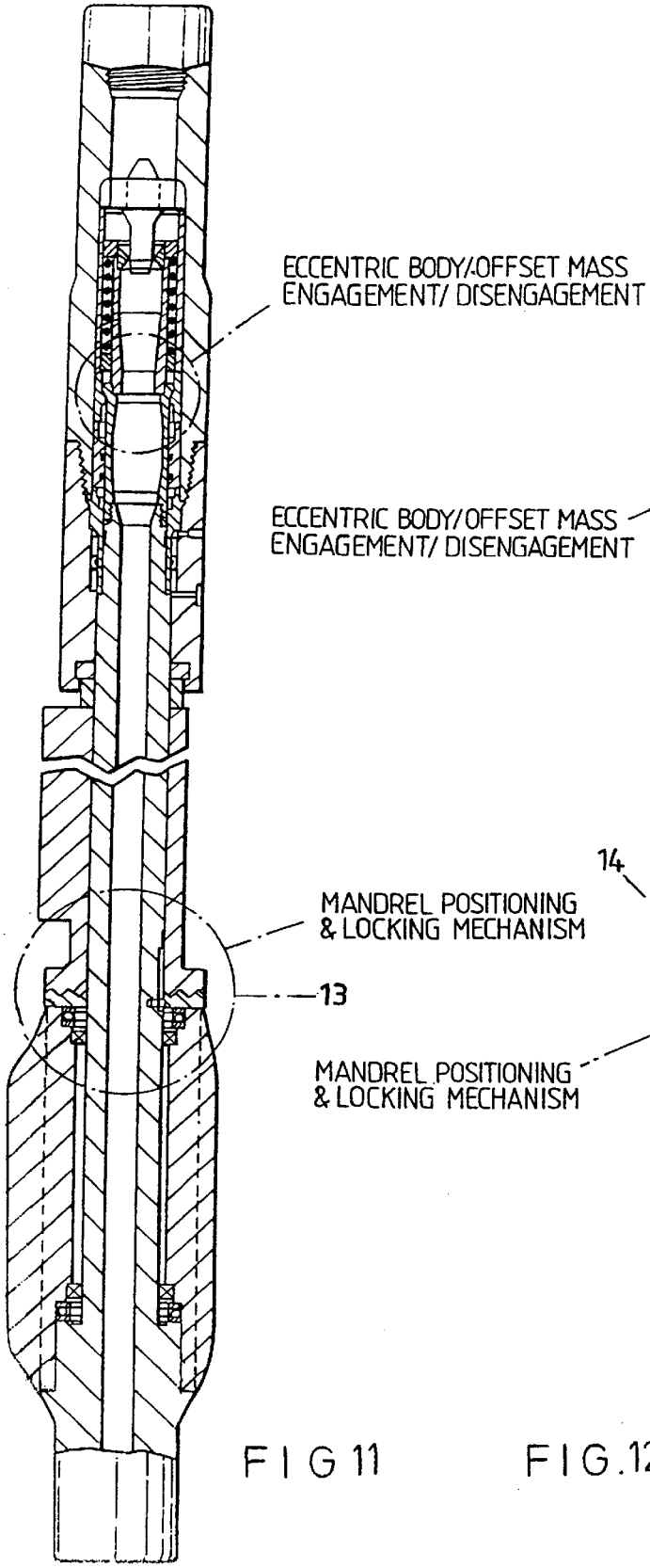
Figure 12:
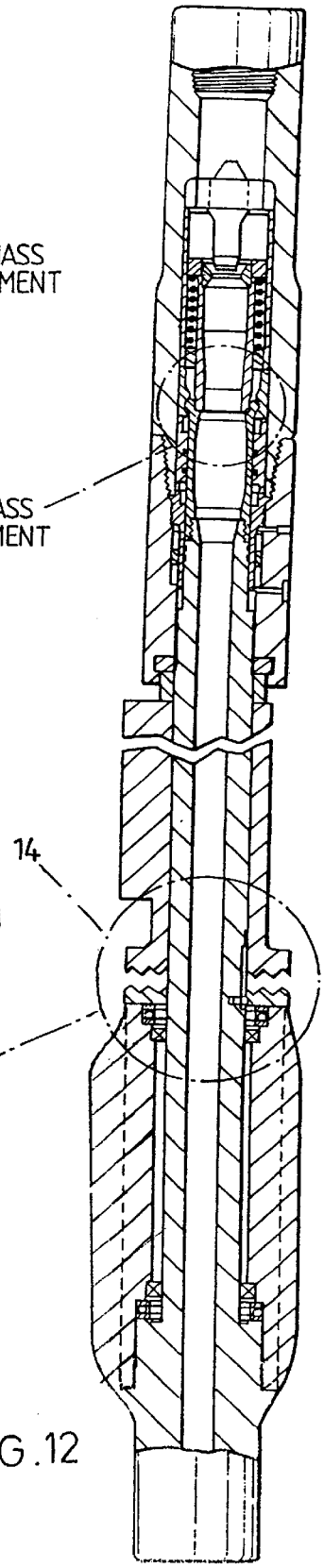
Figure 13:
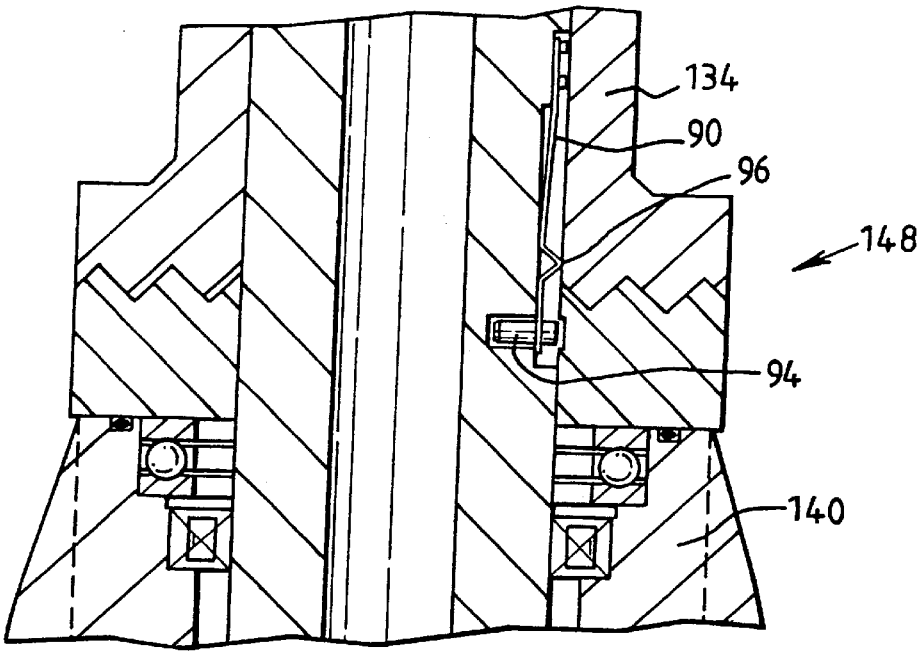
Figure 14:
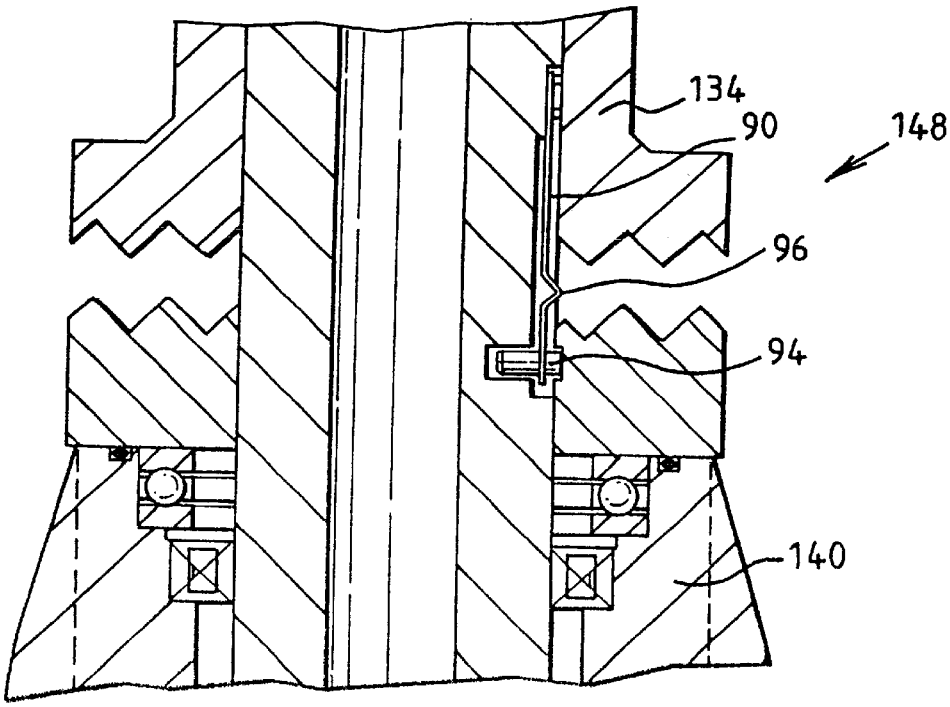

This and other aspects of the present invention will now be described, by way of example, with reference to the accompanying drawings, in which:

FIG. 1 shows the lower end of a drill string provided with directional drilling apparatus in accordance with a first embodiment of the present invention;

FIG. 2 corresponds to FIG. 1, but shows the drilling apparatus in section;

FIG. 3 is an enlarged sectional view of the drilling apparatus of FIG. 1;

FIGS. 4 and 5 correspond to FIG. 2, and illustrate a clutch assembly of the apparatus engaged and disengaged, respectively;

FIGS. 6 and 7 are enlarged views of the clutch assembly of the drilling apparatus and correspond to the circled areas 6 and 7 of FIGS. 4 and 5, respectively;

FIG. 8 shows the lower end of a drill string provided with directional drilling apparatus in accordance with a second embodiment of the present invention;

FIG. 9 corresponds to FIG. 8, but shows the drilling apparatus in section;

FIG. 10 is an enlarged sectional view of the drilling apparatus of FIG. 9;

FIGS. 11 and 12 correspond to FIG. 9, and illustrate a clutch assembly of the apparatus engaged and disengaged, respectively; and FIGS. 13 and 14 are enlarged views of the clutch assembly of the drilling apparatus and corresponding to the circled areas 13 and 14 of FIGS. 11 and 12, respectively

DETAILED DESCRIPTION OF PREFERRED EMBODIMENTS OF THE INVENTION

Reference is first made to FIG. 1 of the drawings, which illustrates the lower end of a drill string 20 located within a drilled bore 22. The string 20 includes a stabiliser 24, drilling apparatus in accordance with a first embodiment of the present invention in the form of a rotary steerable tool assembly 26, and a drill bit 28 joined to the tool assembly 26 by a connecting sub 30. The tool assembly 26 comprises a stabiliser 32 and orientation control means in the form of a non-rotating offset mass 34.

Reference is now also made to FIG. 2 of the drawings, which illustrates the tool assembly 26 in section. The main features and operation of the tool assembly 26 will be described initially, followed by a more detailed description of the individual elements of the assembly 26.

The offset mass 34 of the tool assembly 26 defines an offset bore 36 through which a tubular mandrel 38 extends. The mass 34 is free to rotate on the mandrel 38 and thus tends to remain in the same orientation while the drill string 20, and thus the mandrel 38, is rotated within the bore 22; the tool assembly 26 will only operate in inclined well bores, where the offset mass 34 will position itself to the lower side of the well bore.

In this particular example, for use in a 31.2 cm (12 ¼ inch bore, the mass 34 is formed of steel and is approximately 4.6 m (15 feet) long and has a mass of 1000 kg (2,200 lbs). The mass is arranged such that it s centre of gravity is offset from the mandrel axis by 4.83 cm (1.90 inches), producing a resistive torque of approximately 48 Nm (400 ftlbs).

The mandrel 38 also extends through the szabiliser 32 and is connected to an annular stabiliser body 40 which defines, in this example, three helical blades 42 (see FIG. 1), each of which accommodates a series of pistons which may be radially extended from the blades 42. The inner end portions of the pistons 44 include can follower portions 45 to engage a non-rotating element in the form of a cam 46 which is normally coupled, via a clutch assembly 48, to the offset mass 34. Accordingly, as the drill string 20 is rotated, the offset mass 34 and cam 46 remains substantially stationary within the bore, the high spot on the cam 46 forcing the stabiliser pistons 44 outwardly against the bore wall with each revolution of the string 20. In the illustrated example the pistons 44 will be pushed outwardly into contact with the right hand side of the bore, pushing the drill bit 28, and thus the trajectory of the bore, to the left.

A more detailed description of the tool assembly 26 will now be provided, with reference also to FIGS. 3 to 7 of the drawings.

The stabiliser 24 is connected by way of a threaded connection to a top sub 50 of the tool assembly 26. The top sub 50 provides an entry for drilling fluid into the tool assembly and accommodates a fluid actuated latch assembly 52 which is used to maintain the clutch assembly 48 in the engaged or disengaged configuration; FIG. 3 illustrates the latch assembly 52 maintaining the clutch 48 in the disengaged configuration.

The latch assembly 52 includes a lock tube 54 which is axially slidable within the top sub 50 and defines a venturi 56 towards its upper end. The lock tube 54 is biassed upwardly by a coil spring 58, a guide ring 60 retaining the lower end of the spring 58 relative to a cartridge case 61 between the tube 54 and the sub bore wall. Fixed centrally within the top sub 50 and above the cartridge case 61 is an obstructor member or rocket 62, the lower end of which co-operates with the venturi 56 to limit the flow area through the top sub 50. The interaction of the rocket 62 and the venturi 56 allows the configuration of the latch assembly 52 to be monitored from the surface: in the configuration shown in FIG. 3 the lower end of the rocket 62 is spaced from the venturi 56, such that the pressure drop across the venturi 56 is relatively low; however, in the position shown in FIG. 4 of the drawings, the rocket 62 extends through the venturi 56, restricting the flow area and creating an additional back pressure which may be detected at surface. When there is little or no fluid flow through the top sub 50, the spring S8 lifts the lower end of the lock tube 54 free of a double acting latch 64, thus permitting movement of a collet 66 from one side of the latch 64 to the other; the collet 66 is fluted and spring tensioned such that it may be deflected inwardly to travel over the latch 64.

The collet 66 is threaded to the upper end of the mandrel 38 and slides within a collet support sleeve 68 which extends through the lower end of the top sub 50. A tubular shroud 69 below the sleeve 68 extends into an outer sleeve 70 connected to the top sub 50 by threaded connection 72. The sleeve 70 is splined to the mandrel 38 to prevent relative rotation thereof. To prevent creation of a fluid lock, mud pressure is compensated for at the upper end of the mandrel by a compensation ring 74 which is movable in an annular chamber 71 formed between the shroud 69 and the sleeve 70. The lower portion of the chamber 71 is filled with oil via a sleeve port 76. External drilling fluid is permitted to pass through the outer sleeve 70 into the upper portion of the chamber 71 via a port 78 on the opposite side of the compensation ring 74 from the oil fill port 76. The mud pressure on either side of the mandrel 38 and the shroud 69 may thus be balanced to allow easier movement of the mandrel 38.

As described above, the mandrel 38 extends through the offset mass 34 and the stabiliser 32, the lower end of the mandrel being connected by way of a threaded connection 80 to the rotating stabiliser body 40. The pistons 44 mounted within the body blades 42 are mounted on roller bearings 82 which transfer the lateral movement produced by the offset cam 46 to the pistons 44. Three sets of bearings 84 permit rotation of the mandrel 38 and stabiliser body 40 relative to the cam 46.

The upper end of the cam 46 extends above the stabiliser body 40 and is connected to a flange 86 with a toothed face 87 forming the lower portion of the clutch assembly 48. The upper portion of the clutch assembly 48 is formed by a corresponding flange 88 with a toothed face 89 provided on a lower end of the offset mass 34.

With the clutch assembly 48 engaged the cam 46 is rotationally fixed relative to the offset mass 34.

However, with the clutch assembly 48 released, the cam 46 is free to rotate relative to the mass 34. Further, as illustrated in FIGS. 6 and 7 of the drawings, the clutch assembly 48 is arranged such that, when disengaged, the cam 46 is rotationally fixed relative to the mandrel 38. This is achieved by mounting a leaf spring 90 in a slot 92 in the mandrel 38 at the clutch assembly 48. A pin 94 is provided on the free end of the spring 90 and with the clutch engaged contact between a raised portion of the spring 96 and the inner wall of the upper flange 88 pushes the pin 94 into a recess 98 formed in the mandrel 38. However, when the clutch 48 is disengaged, and the mandrel 38 moves downwardly relative to the upper clutch face 89, the raised portion 96 moves into the gap between the faces 87, 89 and the outer end of the pin moves into a recess 100 provided in the flange 86. This has the effect of connecting the flange 86 and thus the cam 46 to the mandrel 33 such that rotation of the mandrel 38 results in corresponding rotation of the cam 46.

In use, the drill string 20 is rotated in the bore 22 with the drill bit 28 in contact with the cutting face. Drilling fluid is pumped through the string 20 from the surface, the fluid exiting through nozzles in the bit 28 (shown as 101 in FIG. 2), and then carrying rock fragments from the cutting face up through the annulus between the string 20 and bore 22. The clutch assembly 48 is engaged such that the offset mass 34 and the cam 46 are connected and remain stationary as the string 20 and the remainder of the tool assembly 26 rotate. As described above, the offset mass 34 locates itself on the lower side of the inclined bore and such that the high point on the cam 46 remains at the desired orientation within the bore 22, causing the pistons 44 to be extended as they pass over the high point, and tending to deflect the bit 28 towards the opposite side of the bore.

The drilling fluid flowing through the string 20 creates a pressure differential across the venturi 56 such that the lock tube 54 is pushed downwards against the action of the spring 58. The lower end of the lock tube 54 locks the collet 66 on the upper side of the double acting latch 64. Accordingly, as long as the flow of drilling fluid is maintained the collet 66 will be locked in the latch 64, the clutch assembly 48 will remain engaged, and the orientation of the cam 46 will be maintained.

To alter the orientation of the cam 46 and change the bore trajectory, the pumping rate of the drilling fluid is reduced sufficiently to allow the spring 58 to push the lock tube 54 upwardly, clear of the latch 64. If the string 20 is then lifted from bottom, the top sub 50, latch assembly 52, outer sleeve 70 and offset mass 34 are raised relative to the mandrel 38. The weight of the mandrel 38, the stabiliser 32 and the drill bit 28 pull the collet 66 downwards over the latch 64. If the drilling fluid flow rate is then increased once more, the lock tube 54 is pushed downwards and locks the collet 66 on the lower side of the latch 64 as illustrated, for example, in FIGS. 2 and 5.

As mentioned above, the resulting upward movement of the offset mass 34 relative to the stabiliser 32 results in the clutch 48 disengaging, and also the cam 46 being coupled to the mandrel 38. Accordingly, by slowly rotating the drill string 20 it is possible to alter the orientation of the cam 46, the orientation of the cam 46 being electronically signal to the operator on the surface by way of conventional MWD (measuring while drilling) apparatus which apparatus is well known to those of skill in the art.

When the cam 46 is in the desired orientation, the drilling fluid flow rate is reduced once more, such that the lock tube 54 moves upwardly, out of engagement with the collet 66. If weight is applied to the string 20, the collet 66 will then ride over the latch 64 to re-engage the clutch 48, and disengage the pin 94 from the flange 86 such that the cam 46 is again free to rotate relative to the mandrel 38. If the drilling fluid flow rate is increased once more the lock tube 54 moves down to lock the collet 66 in the latch 64, and drilling may then continue.

Reference is now made to FIGS. 8 through 14 of the drawings, which illustrate directional drilling apparatus in accordance with a second embodiment of the preferred invention. The second embodiment shares a number of features with the first described embodiment, and these common features will not be described again in detail, and will be accorded the same reference numerals as were used when describing the first embodiment. The principal difference between the embodiments lie in the rotary steerable tool assembly 126, and more particularly in the eccentric or offset stabiliser 132. In the second embodiment the stabiliser 132 is provided with an eccentric or offset stabiliser body 140 which is normally rotatable on the mandrel 138. Thus, when the offset mass 34 and the stabiliser body 140 are connected via the clutch assembly 148, the stabiliser body 140 remains stationary as the string 20 is rotated. The trajectory of the bore is thus determined by the orientation of the stabiliser body 140.

The orientation of the stabiliser body 140 is changed in a similar manner to the cam 46 as described above in the first embodiment, that is by configuring the latch assembly 52 to allow disengagement of the clutch 148 and to couple the stabiliser body 140 to the mandrel 138 to allow the orientation of the body 140 to be altered relative to the offset mass 34.

It will be evident to those of skill in the art that the above-described embodiments provide relatively simple arrangements which allow the trajectory of an inclined bore to be varied as desired. Further, the adjustable eccentric stabilisers permit changes in trajectory to be effected while the drill string 20 is rotated from the surface and rotation of the drill bit is not solely dependent upon a downhole drilling motor.

It will also be clear to those of skill in the art that the above-described embodiments are merely exemplary of the present invention, and that various modifications and improvements may be made thereto, without departing from the scope of the invention.

What is claimed is:

1. Directional drilling apparatus for location on a drill string for location in an inclined bore having a lower side, the apparatus comprising:

a stabiliser comprising a mandrel for connection to a drill string, the mandrel being adapted for rotation about a longitudinal axis, and a normally non-rotating offsetting means mounted on the mandrel for offsetting the string in the bore; and orientation control means operatively associated with the offsetting means and including a non-rotating offset mass having a center of gravity laterally spaced from said longitudinal axis whereby said offset mass tends to an orientation in the bore with its center of gravity towards the lower side of the bore and said mass is adapted to be coupled to said offsetting means for maintaining a selected circumferential orientation of the offset of the string in the bore as the drill string rotates therein.

2. Directional drilling apparatus for location on a drill string for location in an inclined bore having a lower side, the apparatus comprising:

a stabiliser having a mandrel for connection to a drill string, the mandrel being adapted for rotation about a longitudinal axis, and a normally non-rotating offsetting means mounted on the mandrel for offsetting the string in the bore; and orientation control means operatively associated with the offsetting means and including a non-rotating offset mass having a center of gravity laterally spaced from said longitudinal axis such that said offset mass tends to an orientation in the bore with its center of gravity towards the lower side of the bore and said mass is adapted to be rotationally coupled to said offsetting means for maintaining a selected circumferential orientation of the offset of the string in the bore as the string rotates therein, wherein the stabiliser is of a larger gauge than the non-rotating offset mass.

3. The apparatus of claim 2, wherein the offset mass is rotatable on the mandrel.

4. The apparatus of claim 3, wherein the mass is rotationally fixed relative to the offsetting means.

5. The apparatus of claim 3, wherein the offsetting means is adapted to be positioned in one of two possible circumferential orientations relative to the offset mass, such that apparatus may be utilised to turn a bore to the one side or the other, depending on the orientation selected.

6. The apparatus of claim 5, in combination with an adjustable stabiliser, whereby may be utilised the apparatus to control the bore azimuth and the stabliliser to control the bore inclination.

7. The apparatus of claim 3, wherein the mass is disengageable from the offsetting means to permit the relative rotational positions thereof to be varied, and the disengagement and re-engagement of the mass and offsetting means being executable remotely.

8. The apparatus of claim 3, wherein the mass is disengageable from the offsetting means to permit the relative positions thereof to be varied as desired, and thus vary the circumferential orientation of the offsetting means in the bore and permit drilling of a bore of varying inclination and azimuth.

9. The apparatus of claim 8, wherein a clutch is provided between the mass and offsetting means.

10. The apparatus of claim 9, wherein the clutch is adapted to be disengaged by applying tension to the apparatus.

11. The apparatus of claim 9, wherein the clutch has a locked configuration to prevent accidental disengagement.

12. The apparatus of claim 11, wherein the clutch is provided with a drilling fluid actuated latch.

13. The apparatus of claim 9, wherein the clutch includes means for connecting the mandrel relative to the offsetting means and which means operates on the clutch disengaging, permitting the offsetting means to be rotated to a desired orientation by rotation of the string, and on the clutch re-engaging the connecting means disengages the offsetting means from the mandrel.

14. The apparatus of claim 1 wherein the offsetting means comprises a cam for location between the mandrel and an outer stabiliser body including extendible bearing elements including cam follower portions.

15. The apparatus of claim 1, wherein the offsetting means is an eccentric stabiliser body.

16. The apparatus of claim 1, in combination with a further stabiliser for location on the string above the stabiliser including the offsetting means.

17. A directional drilling method comprising:

providing a stabiliser comprising a mandrel adapted for rotation about a longitudinal axis and a normally non-rotating offset arrangement on the mandrel, connecting the stabiliser mandrel to a drill string;

connecting a non-rotating offset mass having a center of gravity laterally spaced from said longitudinal axis to said offset arrangement; and rotating the drill string in an inclined bore from the surface, with the center of gravity of the offset mass located towards a lower side of the inclined bore and maintaining said offset arrangement at a selected circumferential orientation in the bore to offset the string in the bore as the string rotates therein.

18. The method of claim 17, further comprising providing a stabiliser of a larger gauge than the non-rotating offset mass, such that the offset mass remains clear of the bore wall.

19. The method of claim 18, wherein the stabiliser gauge is selected to be the same as or slightly smaller than the bore gauge.

20. The method of claim 17, further comprising disengaging the offset mass from the offset arrangement, altering the relative rotational positions thereof and re-engaging the mass and offset arrangement, to alter the orientation of the offset arrangement relative to the bore.

21. The method of claim 20, in which the disengagement and re-engagement of the mass and offset arrangement is executed remotely, from surface.

22. The method of claim 21, including connecting the mandrel to the offset arrangement when the mass and the offset arrangement are disengaged, rotating the string to rotate the offset arrangement to a desired circumferential orientation, and disengaging the offset arrangement from the mandrel on re-engagement of the mass and the offset arrangement.

23. The method of claim 17, including providing a further stabiliser on the string above the stabiliser including the offset arrangement.

* * * * *